US008622084B2

(12) United States Patent
Ishii et al.

(10) Patent No.: US 8,622,084 B2
(45) Date of Patent: Jan. 7, 2014

(54) LIQUID-SUCTIONING TANK AND DROPLET DISCHARGE DEVICE PROVIDED WITH THE SAME

(75) Inventors: Hiroyuki Ishii, Nagano (JP); Akihiro Satake, Mikawa-machi (JP); Nobuyuki Hayasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 286 days.

(21) Appl. No.: 12/697,739

(22) Filed: Feb. 1, 2010

(65) Prior Publication Data

US 2010/0193055 A1 Aug. 5, 2010

(30) Foreign Application Priority Data

Feb. 4, 2009 (JP) ..... 2009-023176

(51) Int. Cl.
*E03C 1/18* (2006.01)

(52) U.S. Cl.
USPC ..... 137/582; 137/558; 137/592

(58) Field of Classification Search
USPC ..... 137/582, 590, 592, 561 A, 392, 395, 137/558; 347/92; 73/232
See application file for complete search history.

(56) References Cited

U.S. PATENT DOCUMENTS

| | | | | | |
|---|---|---|---|---|---|
| 1,313,831 | A | * | 8/1919 | Owens | 137/582 |
| 1,319,057 | A | * | 10/1919 | Feldmeier | 137/574 |
| 2,544,576 | A | * | 3/1951 | Weber | 137/592 |
| 2,683,463 | A | * | 7/1954 | Flick | 137/255 |
| 2,693,000 | A | * | 11/1954 | Minerley | 15/320 |
| 3,736,955 | A | * | 6/1973 | Schlesser | 137/561 A |
| 3,883,329 | A | * | 5/1975 | Dupps, Sr. | 96/235 |
| 3,899,000 | A | * | 8/1975 | Ohlswager et al. | 137/561 A |
| 5,477,256 | A | * | 12/1995 | Loyd et al. | 347/93 |
| 5,694,974 | A | * | 12/1997 | Niemiro et al. | 137/392 |
| 6,155,679 | A | | 12/2000 | Sato | |
| 6,328,442 | B1 | * | 12/2001 | Brinkly | 347/104 |
| 6,397,745 | B2 | * | 6/2002 | Koehler | 101/366 |
| 6,497,143 | B1 | * | 12/2002 | Rinkewich | 73/224 |
| 6,558,450 | B2 | * | 5/2003 | Sengupta et al. | 95/46 |
| 6,964,278 | B2 | * | 11/2005 | Tschanz | 137/392 |

FOREIGN PATENT DOCUMENTS

| | | | |
|---|---|---|---|
| JP | 01-165445 | A | 6/1989 |
| JP | 2000-71474 | A | 3/2000 |
| JP | 2007-210121 | A | 8/2007 |
| JP | 2007-244968 | A | 9/2007 |
| JP | 2008-80209 | A | 4/2008 |

* cited by examiner

*Primary Examiner* — John Rivell
*Assistant Examiner* — Ian Paquette
(74) *Attorney, Agent, or Firm* — Global IP Counselors, LLP

(57) ABSTRACT

A liquid-suctioning tank includes a liquid inflow port, a gas outflow port, a baffle plate and a guide member. The liquid inflow port communicates with an upper space of a surface of a liquid, and configured and arranged to be connected to a liquid-suctioning object. The gas outflow port communicates with the upper space, and configured and arranged to be connected to a suctioning device so that a negative pressure is applied to the upper space by the suctioning device to trap liquid from the liquid-suctioning object using suction. The baffle plate is disposed in the upper space so that the liquid flowing from the liquid inflow port collides against the baffle plate. The guide member has a guiding wall configured and arranged to guide the liquid that has collided with the baffle plate from the baffle plate toward the surface of the liquid.

13 Claims, 12 Drawing Sheets

(a)

(b)

LIQUID-SUCTIONING TANK AND DROPLET DISCHARGE DEVICE PROVIDED WITH THE SAME

CROSS-REFERENCE TO RELATED APPLICATIONS

This application claims priority to Japanese Patent Application No. 2009-023176 filed on Feb. 4, 2009. The entire disclosure of Japanese Patent Application No. 2009-023176 is hereby incorporated herein by reference.

BACKGROUND

1. Technical Field

The present invention relates to a liquid-suctioning tank and a droplet discharge device provided with the liquid-suctioning tank, in which a liquid is suctioned via a liquid-suctioning object and trapped by using a suction device to apply negative pressure to an upper space.

2. Related Art

Liquid-suctioning tanks (recovery tanks) known in the art and described as above have a liquid inflow port that is in communication with liquid in the tank, and a gas outflow port that is connected to a suction device and is in communication with the space above the surface of the liquid (see Japanese Laid-Open Patent Application No. 2008-80209).

SUMMARY

The liquid inflow port will corrode when submerged in a fluid. For this reason, there is adopted a structure in which the liquid inflow port is disposed (in the space) above the liquid surface in the liquid-suctioning tank, and liquid is allowed to flow from above the liquid surface to be recovered.

However, there is a problem with such a configuration in that the liquid disperses (into a mist) when it flows down to the liquid surface, and enters the gas outflow port in the form of a dispersed mist, whereupon the devices (particularly the seal portions and the like) of the suction system corrode. In other words, when the flow rate of the downward-flowing liquid and the falling distance inside the liquid-suctioning tank exceed a certain tolerance range, a problem arises in that the liquid will be more dramatically dispersed. It is possible to consider reducing the distance between the liquid surface and the liquid inflow port as much as possible, but in such a case, the liquid inflow port will be submerged in the fluid when the height of the liquid surface is increased by liquid collection.

One object of the present invention is to provide a liquid-suctioning tank and a droplet discharge device provided with the liquid-suctioning tank in which it is possible to prevent dispersion of the liquid that flows downward to the liquid surface from the liquid inflow port open unto the upper space.

A liquid-suctioning tank according to one aspect of the present invention includes a liquid inflow port, a gas out flow port, a baffle plate, and a guide member. The liquid inflow port communicates with an upper space of a surface of a liquid when the liquid is stored in the liquid-suctioning tank. The liquid inflow port is configured and arranged to be connected to a liquid-suctioning object. The gas outflow port communicates with the upper space, and configured and arranged to be connected to a suctioning device so that a negative pressure is applied to the upper space by the suctioning device to trap liquid from the liquid-suctioning object using suction. The baffle plate is disposed in the upper space so that the liquid flowing from the liquid inflow port collides against the baffle plate. The guide member has a guiding wall configured and arranged to guide the liquid that has collided with the baffle plate from the baffle plate toward the surface of the liquid.

In accordance with this configuration, liquid that has flowed in from the liquid inflow port collides with the baffle plate and is guided to the liquid surface by the guiding wall. Thus, the falling distance of the fluid that has flowed in from the liquid inflow port can be reduced and the fluid is guided to the liquid surface under a reduced the flow rate. Therefore, dispersion of the liquid to the liquid surface can be minimized. The liquid inflow port will not become submerged in the fluid even when the height of the liquid surface has risen. As used herein, a "guiding wall" in the present specification refers to a surface or plane without thickness.

In the liquid-suctioning tank, the liquid inflow port may be opened in a ceiling of the liquid-suctioning tank, the baffle plate may be horizontally arranged directly below the liquid inflow port, and the guide member may have a cylindrical body that encloses the baffle plate so that an inner surface of the guide member forms the guiding wall.

Also, an upper end of the guide member may be secured to the ceiling of the liquid-suctioning tank.

In accordance with this configuration, the liquid inflow port can be prevented from corroding due to the liquid inflow port being provided in the tank ceiling. Since the baffle plate for receiving the fluid from the liquid inflow port is horizontally disposed, the fluid flows down the baffle plate in a radial fashion. Accordingly, the flow rate of the downwardly flowing fluid is dramatically reduced and the fluid can thereafter be guided to the guiding wall. A guiding wall is furthermore provided so as to envelope the baffle plate, whereby the guiding wall serves as a liquid-proofing cover, and liquid that has collided with the baffle plate can be prevented from dispersing over the entire liquid-suctioning tank. Function as the liquid-proofing cover can be enhanced by further securing the guide member to the tank ceiling wall.

Additionally, the lower end of the guide member may extend to a vicinity of a bottom wall of the liquid-suctioning tank.

In accordance with this configuration, the lower end of the guide member extends to the vicinity of the tank bottom wall, and thus the fluid that has collided can be slowly guided to the liquid surface at an unchanged speed regardless of the height of the liquid surface.

Additionally, the guide member may include at least one of a through-hole and a notched part.

In accordance with this configuration, the pressure inside and outside the guide member can be made uniform by forming in the guide member a through-hole and/or a notched part for placing the interior and the exterior of the guide member in communication.

Additionally, a surface area of a gap between the guide member and the baffle plate may be substantially the same as a cross-sectional area of the liquid inflow port.

In accordance with this configuration, the liquid can be smoothly guided to the liquid surface while the dispersion of the liquid is suppressed because the gap area between the guide member and the baffle plate, and the cross-sectional area of the liquid inflow port are formed to be substantially the same, whereby the flow rate from the liquid inflow port and the flow rate from the gap between the guide member and the baffle plate are made to be substantially the same.

Additionally, an inner wall of the liquid-suctioning tank may form a part of the guiding wall.

In accordance with this configuration, the liquid-suctioning tank can be provided with a simple configuration because the guide member and the tank inner wall of the liquid-suctioning tank can be integrally formed (i.e., be of dual-purpose construction).

Additionally, the baffle plate may be arranged with a slope having a downstream end facing an inner wall of the liquid-suctioning tank with a gap therebetween, and the inner wall of the liquid-suctioning tank may form the guide member.

In accordance with this configuration, liquid that has flowed in from the liquid inflow port collides with the baffle plate, is thereafter guided by the baffle plate, is brought to the tank inner wall, and is guided to the liquid surface. Accordingly, the liquid-suctioning tank can be provided with a simple configuration because the tank inner wall is integrally formed with (doubles as) the guide member.

Additionally, the liquid-suctioning tank may further include an annular frame unit provided in a generally vertical intermediate position of an inner wall of the liquid-suctioning tank.

In accordance with this configuration, the strength of the tank can be increased and the capacity of the tank can be increased with a thin plate material.

Additionally, the liquid inflow port may be configured and arranged to be connected to a suction cap as the liquid-suctioning object configured and arranged to suction functional fluid from an ink-jet head with the suction cap being selectively detachable from the functional droplet discharging head. The gas outflow port may be configured and arranged to be connected to an ejector as the suctioning device with the ejector having a secondary side connected to the liquid inflow port.

In accordance with this configuration, the suction process of the functional droplet discharging head can be carried out with good precision by using the liquid-suctioning tank described above in a suction system of an ink jet head. The suction device can be provided with a simple configuration by configuring the suction device to be an ejector.

A droplet discharge device according to another aspect of the present invention includes the liquid-suctioning tank, the suction cap connected to the liquid-suctioning tank, the functional droplet discharging head from which the suction cap is selectively detached, and the ejector connected to the liquid-suctioning tank.

In accordance with this configuration, the suction process of the functional droplet discharging head can be carried out with good precision by using the liquid-suctioning tank described above in a suction system of a droplet discharge device. Consequently, the drawing process of the functional droplet discharging head can be carried out with good precision.

BRIEF DESCRIPTION OF THE DRAWINGS

Referring now to the attached drawings which form a part of this original disclosure.

DETAILED DESCRIPTION OF EXEMPLARY EMBODIMENTS

A droplet discharge device in which the liquid-suctioning tank of the present invention has been applied is described below with reference to the attached drawings. The droplet discharge device is incorporated in a manufacturing line for flat panel displays, and is used for forming filter elements or the like of a color filter or a luminous layer that will constitute the pixels of an organic EL device, using a functional droplet discharging head into which a functional fluid (liquid), which is, e.g., an special ink or a luminous resin fluid, has been introduced. In particular, the droplet discharge device can reduce problems brought about by dispersion of the functional fluid by using a drainage tank (liquid-suctioning tank) that can reduce the dispersion of the functional fluid in the suction unit.

Figure 1:
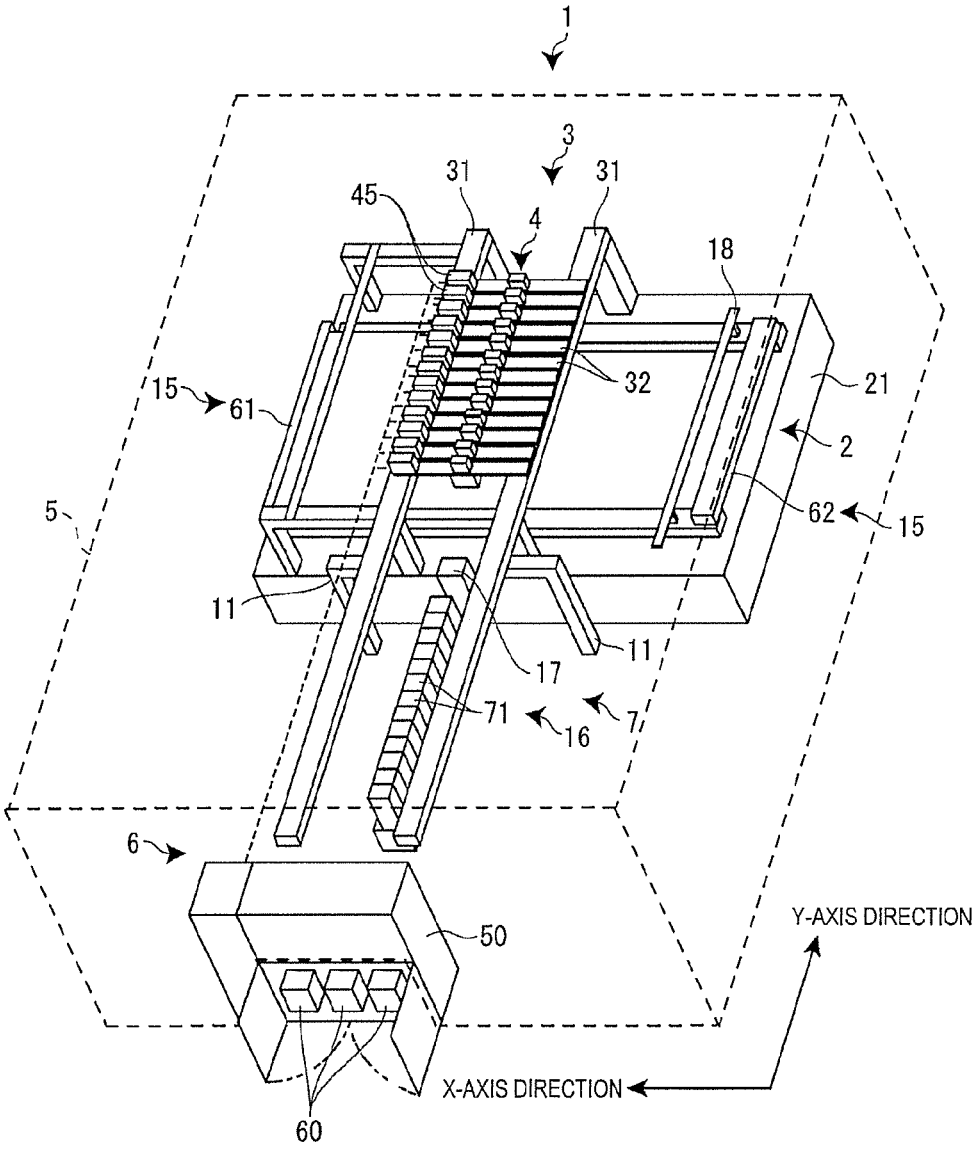
FIG. 1 is a perspective view of the droplet discharge device of the embodiments of the present invention.
Figure 2:
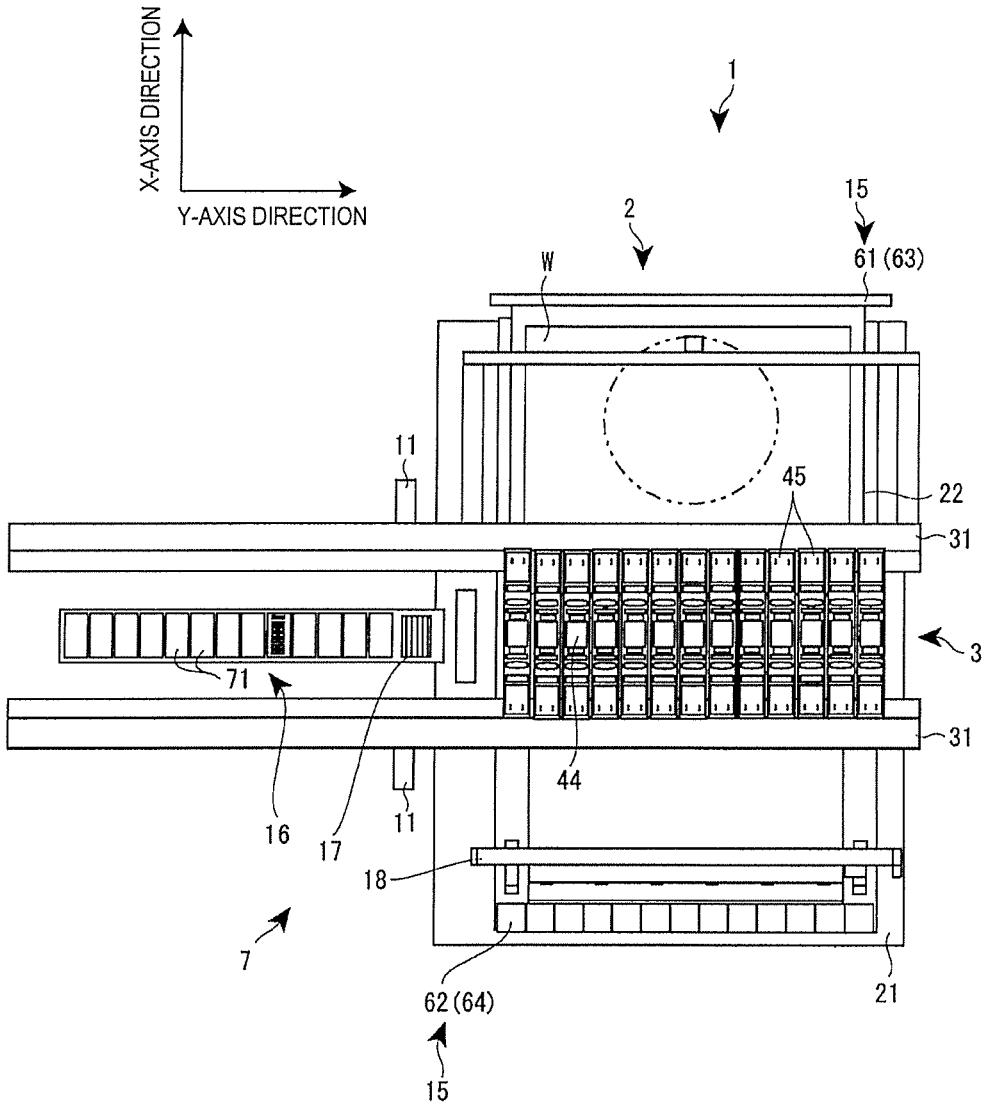
FIG. 2 is a plan view of the droplet discharge device of the embodiments of the present invention.
Figure 3:
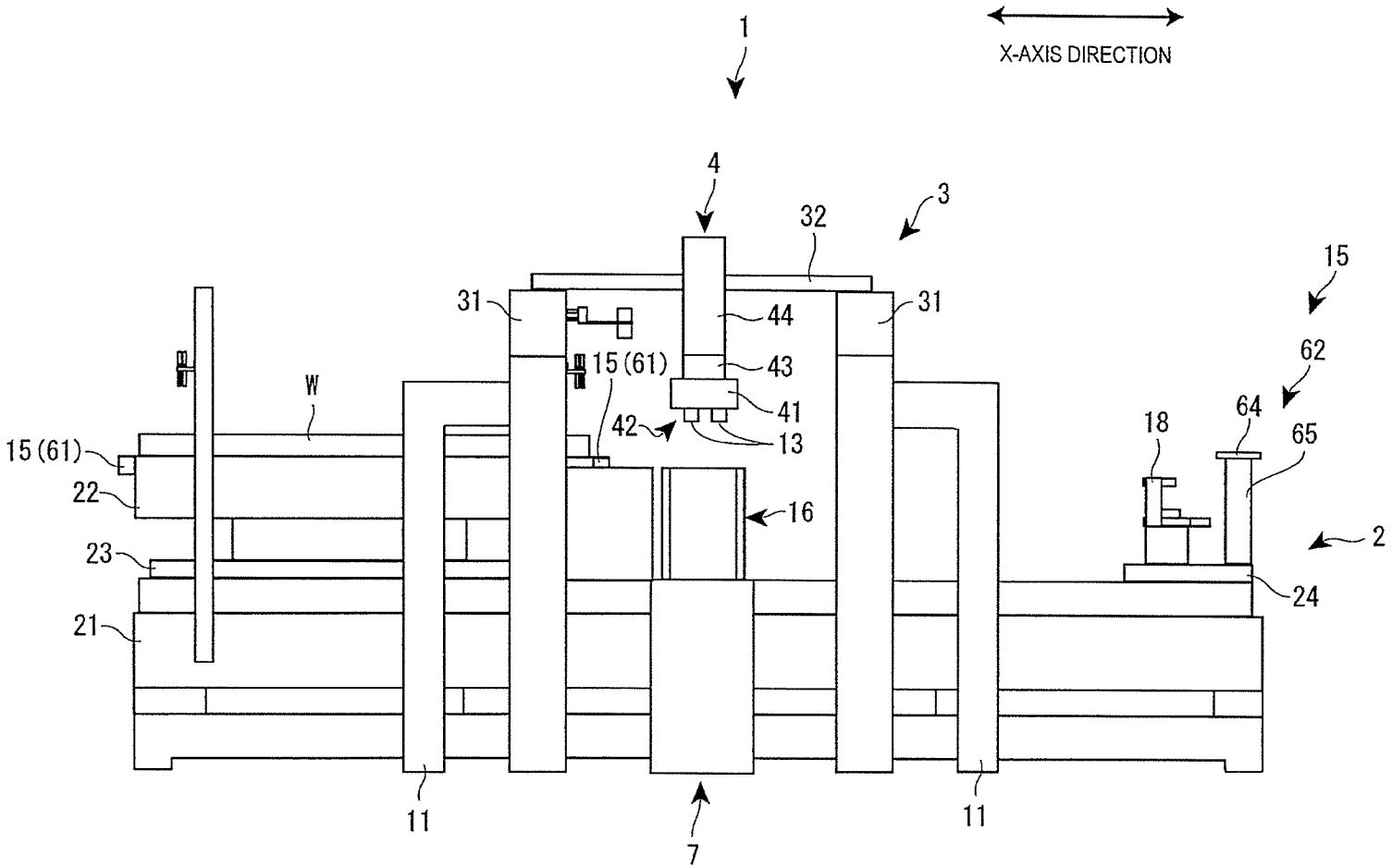
FIG. 3 is a side view of the droplet discharge device of the embodiments of the present invention.

A droplet discharge device 1 is composed of an X-axis table 2, a Y-axis table 3, and 13 carriage units 4, as shown in FIGS. 1 to 3. The X-axis table 2 is disposed on an X-axis support base 21 supported on a stone base, extends in the X-axis direction as the main scanning direction, and moves a workpiece W in the X-axis direction. The Y-axis table 3 is disposed on a pair of Y-axis support bases 31 so as to span and straddle the X-axis table 2 via a plurality of support columns 11, and extends in the Y-axis direction as the sub-scanning direction. The carriage units 4 are movably suspended on the Y-axis table 3 and each carriage unit has a plurality (12) of functional droplet discharging heads 13. The droplet discharge device 1 furthermore comprises a chamber 5 for accommodating these devices in a temperature- and humidity-controlled atmosphere; a functional fluid supply unit 6 for supplying functional fluid to the functional droplet discharging heads 13, being provided through the chamber 5; and a control device (not shown) for controlling each unit. A tank cabinet 50 for accommodating a main tank 60 and the like that forms the main part of the functional fluid supply unit 6 is provided to a portion of the sidewall of the chamber 5. The droplet discharge device 1 drives the functional droplet discharging heads 13 so that discharging/driving is carried out in synchronization with the driving of the X-axis table 2 and the Y-axis table 3, whereby six colors of function droplets supplied from the functional fluid supply unit 6 are discharged and a predetermined drawing pattern is drawn on the workpiece W.

The droplet discharge device 1 is provided with a maintenance device 7 composed of a flushing unit 15, a suction unit 16, a wiping unit 17, and a discharge performance inspection unit 18. These units provide maintenance to the functional droplet discharging heads 13 and maintain and restore function to the functional droplet discharging heads 13. In the droplet discharge device 1 of the present embodiment, the carriage units 4 are made to face the area in which the X-axis table 2 and the Y-axis table 3 intersect to draw on a workpiece W; and the carriage units 4 are made to face the area in which the Y-axis table 3 and the maintenance device 7 (the suction unit 16 and the wiping unit 17) intersect so as to subject the functional droplet discharging heads 13 to functional maintenance and functional restoration.

As shown in FIGS. 2 and 3, the X-axis table 2 is provided with a positioning table 22 for chucking a workpiece W, having a function for making corrections in the θ-axis direction; an X-axis first slider 23 for slidably supporting the positioning table 22 in the X-axis direction; an X-axis second slider 24 for slidably supporting the flushing unit 15 and the discharge performance inspection unit 18 in the X-axis direction; and a pair of left and right X-axis linear motors (not shown) that extend in the X-axis direction and move the X-axis first slider 23 and the X-axis second slider 24 in the X-axis direction.

The Y-axis table 3 is provided with 13 bridge plates 32 from which 13 carriage units 4, respectively, are suspended; 13 sets of Y-axis sliders (not shown) for supporting the 13 bridge plates 32 at the two ends thereof; and a pair of Y-axis linear motors (not shown) for moving the bridge plates 32 in the Y-axis direction, being disposed on the pair of Y-axis support bases 31. The Y-axis table 3 sub-scans the functional droplet discharging heads 13 via the carriage units 4 during the drawing process, and causes the functional droplet discharging heads 13 to face the suction unit 16 and the wiping unit 17. In this case, the carriage units 4 can be made independent and moved individually, and the 13 carriage units 4 can be moved as a single unit.

Figure 4:
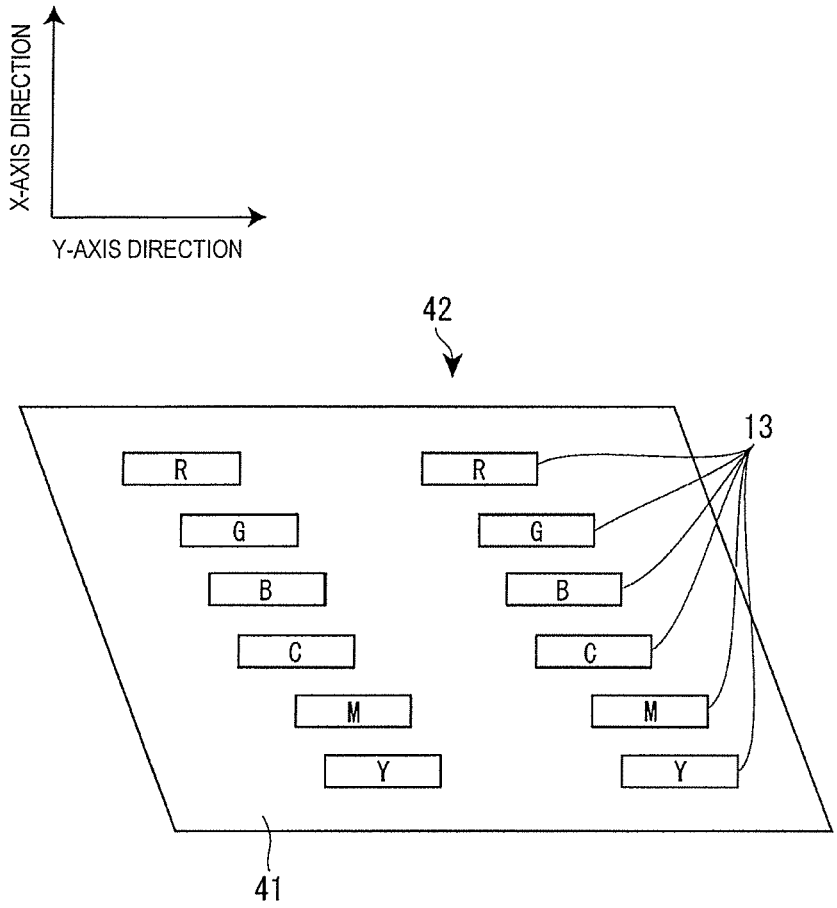
FIG. 4 is a plan view that schematically shows the head unit on which the functional droplet discharging head is mounted.

Each of the carriage units 4 is provided with a head unit 42 composed of two (12 total) functional droplet discharging heads 13 for each of six colors R, G, B, C, M, and Y; and a head plate 41 for supporting the 12 functional droplet discharging heads 13 in two groups of six (see FIG. 4). Each of the carriage units 4 is provided with a θ-rotation mechanism 43 for supporting the head unit 42 so as to allow θ correction (θ rotation), and a suspension member 44 in which the head unit 42 is supported by a bridge plate 32 via the θ-rotation mechanism 43. Additionally, each carriage unit 4 has a sub-tank 45 arranged above each carriage unit (actually arranged on the bridge plate 32), and a configuration in which functional fluid is supplied to the functional droplet discharging heads 13 via a pressure-regulating valve and by using the natural head from the sub-tank 45. In the present embodiment, there are 13 carriage units 4 and 12 functional droplet discharging heads 13 mounted on each carriage unit 4, but the number of carriage units 4 and the number of functional droplet discharging heads 13 mounted on each carriage units 4 is arbitrary.

Figure 5:
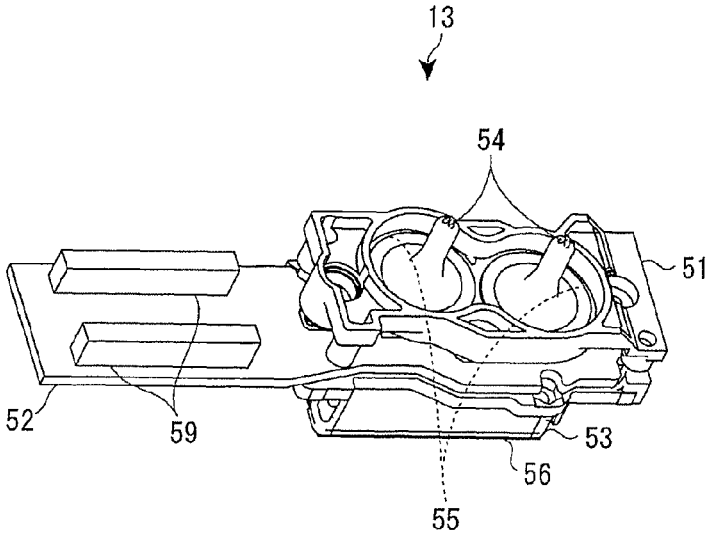
FIG. 5 includes perspective views (a) and (b) of the external appearance of the front and back of the functional droplet discharging head.
Figure 5:
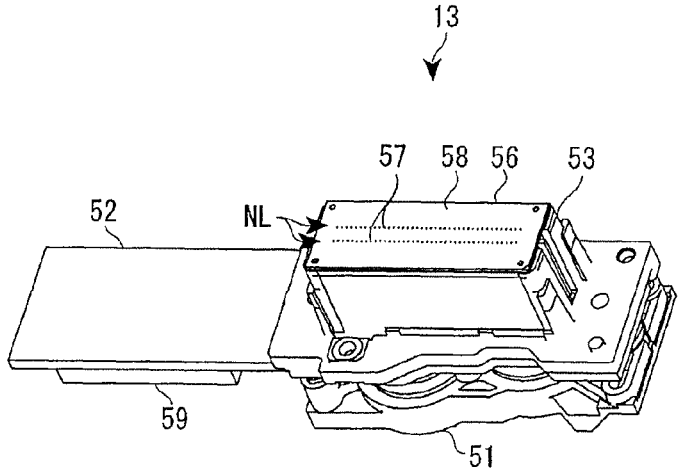

As shown in FIG. 5, the functional droplet discharging head 13 is a so-called two-row inkjet head, and is provided with a fluid introduction section 51 having two connection needles 54, as well as a two-row head plate 52 connected to the fluid introduction section 51. A head main unit 53 for discharging functional fluid is connected below the head plate 52 (see FIG. 5(*a*)).

The fluid introduction section 51 has a pair of connection needles 54, and is designed to receive a supply of functional fluid from the sub-tank 45. The head main unit 53 has a two-row pump section 55 composed of piezoelements or the like, and a nozzle plate 56 having a nozzle surface 58 on which a plurality of discharge nozzles 57 is formed. Numerous discharge nozzles 57 formed in the nozzle surface 58 of the nozzle plate 56 constitute two nozzle rows NL aligned parallel to each other yet positionally offset by a half nozzle pitch. The nozzle rows NL are composed of 180 discharge nozzles 57 aligned at equal pitch (see FIG. 5(*b*)). A pair of connectors 59 is mounted on the head substrate 52, and each connector 59 is connected to the above-described control device via a flexible flat cable (not shown). A drive waveform outputted from the control device is applied to the pump sections 55 (piezoelectric elements) via the connectors 59, whereby functional fluid is discharged from the discharge nozzles 57.

The flushing unit 15 has a pair of pre-drawing flushing units 61, 61 and a periodic flushing unit 62, as shown in FIGS. 1 through 3, and receives waste discharge from the functional droplet discharging heads 13. This action is performed prior to a drawing process and during pauses in the drawing process when a workpiece W is replaced. The suction unit 16 has 13 cap units 71, forcibly suctions functional fluid from the discharge nozzles 57 of the functional droplet discharging heads 13, and performs a capping process. The wiping unit 17 wipes the nozzle surface 58 of the functional droplet discharging heads 13 after suctioning. The discharge performance inspection unit 18 inspects for flight curvature and whether there is any discharge from the functional droplet discharging heads 13.

The periodic flushing unit 62 has a periodic flushing box 64 for receiving functional fluid, and a pair of box support column members 65 mounted on the X-axis second slider 24 and used for height-adjustably supporting the two ends of the periodic flushing unit 62. The periodic flushing unit 62 receives the functional fluid of the periodic flushing that is carried out by discharging/driving all the functional droplet discharging heads 13 of the head unit 42 when the drawing process is temporarily paused such as when the workpiece W is replaced. As a result, the functional droplet discharging heads 13 can be prevented from drying out and the nozzles can be prevented from becoming plugged during a pause in the drawing.

The pre-drawing flushing unit 61 is composed of a pair of pre-drawing flushing boxes 63 that receive functional fluid, and a pair of box support members (not shown) for supporting the pair of pre-drawing flushing boxes 63 on the positioning table 22. The pre-drawing flushing unit 61 receives the functional fluid of the pre-drawing flushing that is carried out by discharging/driving all the functional droplet discharging heads 13 of the head unit 42 immediately prior to discharging functional fluid onto the workpiece W. The discharge of the functional droplet discharging heads 13 immediately prior to drawing can thereby be stabilized and the drawing process can be carried out with good precision on the workpiece W.

Next, the suction unit 16 is described in detail with reference to FIGS. 6 through 8. The suction unit 16 is provided with 13 cap units 71 in which 12 head caps 81 that correspond to the 12 functional droplet discharging heads 13 are arranged on the cap plate 82; 13 elevator mechanisms 73 for elevating the cap units 71 via the a support member 83; 13 suction flow channel systems 74 connected to the cap units 71 and having a functional fluid suction flow channel; and a suction mechanism 75 connected to the suction flow channel systems 74 and having two drainage tanks 101 that correspond to two pressure levels. The suction unit 16 is also provided with a compressed-air supply apparatus 76 for supplying compressed air for control to a later-described pressure control mechanism 102 and the like, an exhaust apparatus 77 for exhausting air from various sections, and a functional fluid drainage apparatus 78 connected to the drainage tanks 101 and used for draining accumulating functional fluid.

Figure 7:
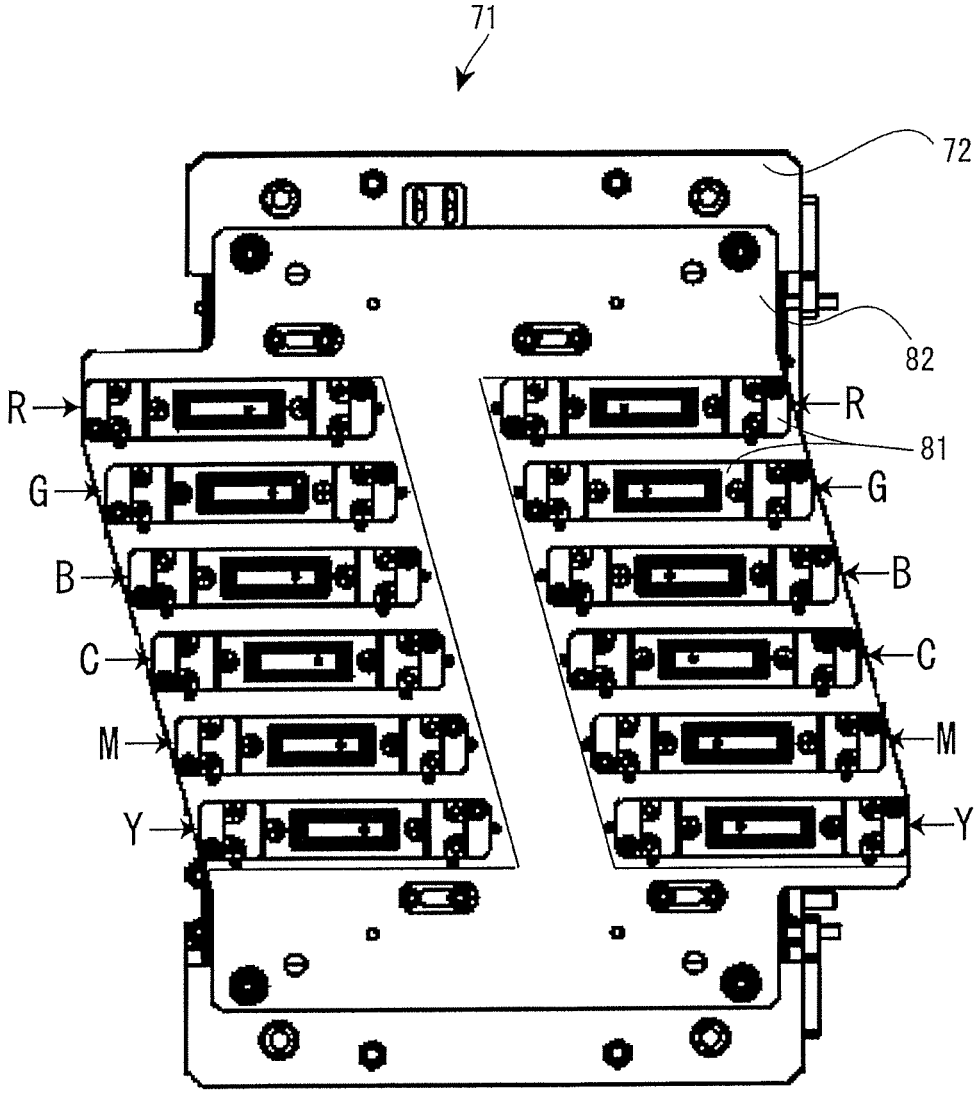
FIG. 7 is a plan view of the cap unit.

The cap units 71 are composed of head caps (suction caps) 81, two colors each, that correspond to the 12 functional droplet discharging heads 13; and a cap plate 82 on which the above are mounted, as shown in FIG. 7. The 12 head caps 81 are mounted on the cap plate 82 in the same alignment and the same slope orientation as the 12 functional droplet discharging heads 13.

Figure 6:
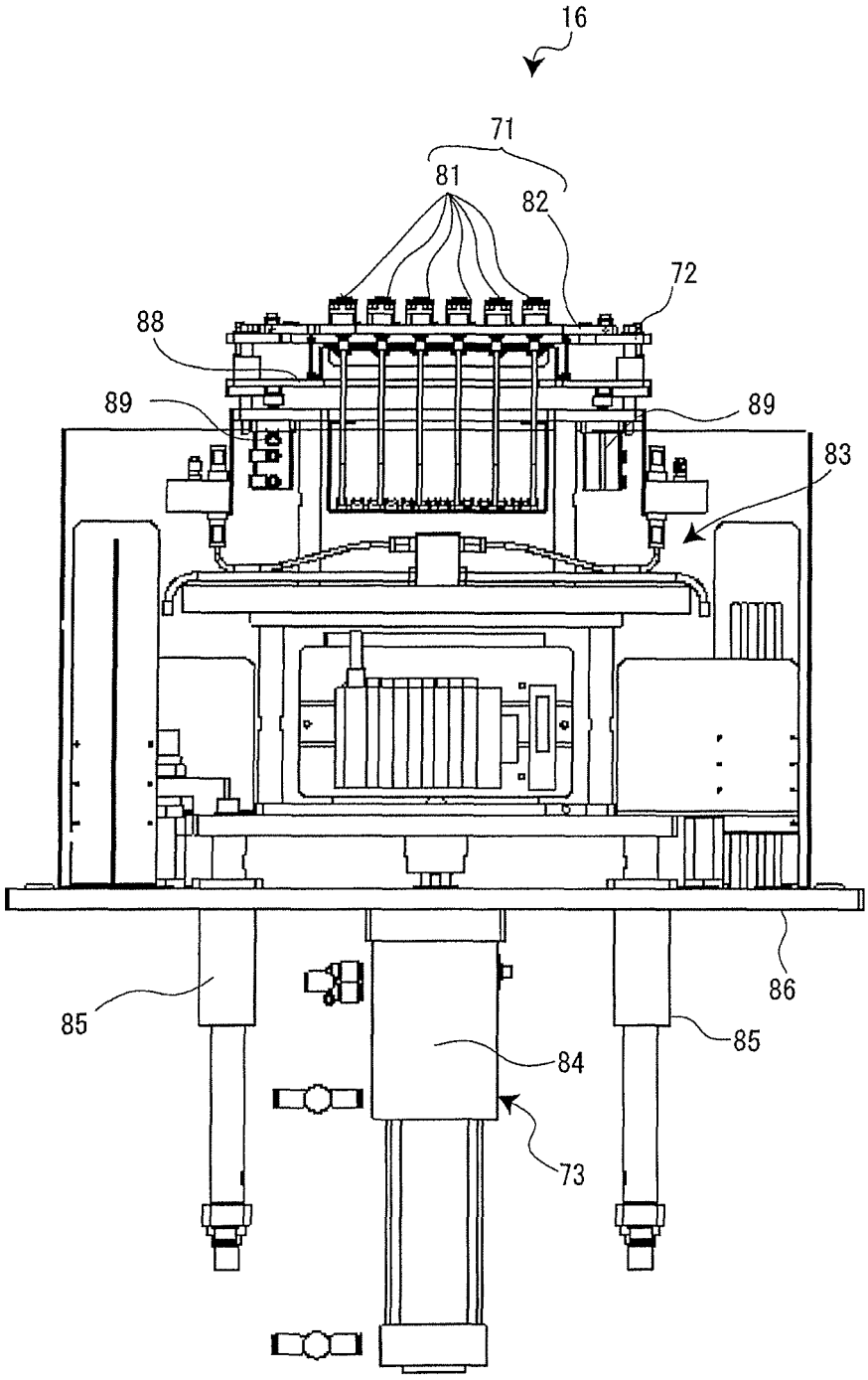
FIG. 6 is a side view of the suction unit.

The elevator mechanism 73 has an elevator cylinder 84 for directly elevating the head caps 81 via the support member 83, a pair of linear guides 85 for guiding the elevating performed by the elevator cylinder 84, and a base section 86 for supporting the above, as shown in FIG. 6. The support member 83 has a support member main unit having a support frame 72 for supporting the cap units 71 at the upper end, an open-to-atmosphere frame 88 for collectively opening open-to-atmosphere valves (not shown) of the 12 head caps 81, and a pair of air cylinders 89, 89 for moving the open-to-atmosphere frame 88 downward. The elevator mechanism 73 moves the cap units 71 in three steps between a close contact position for suction, a clearance position for flushing, and a replacement position for replacing the head unit 42 and replacing (maintenance) the consumable parts of the cap units 71.

Figure 8:
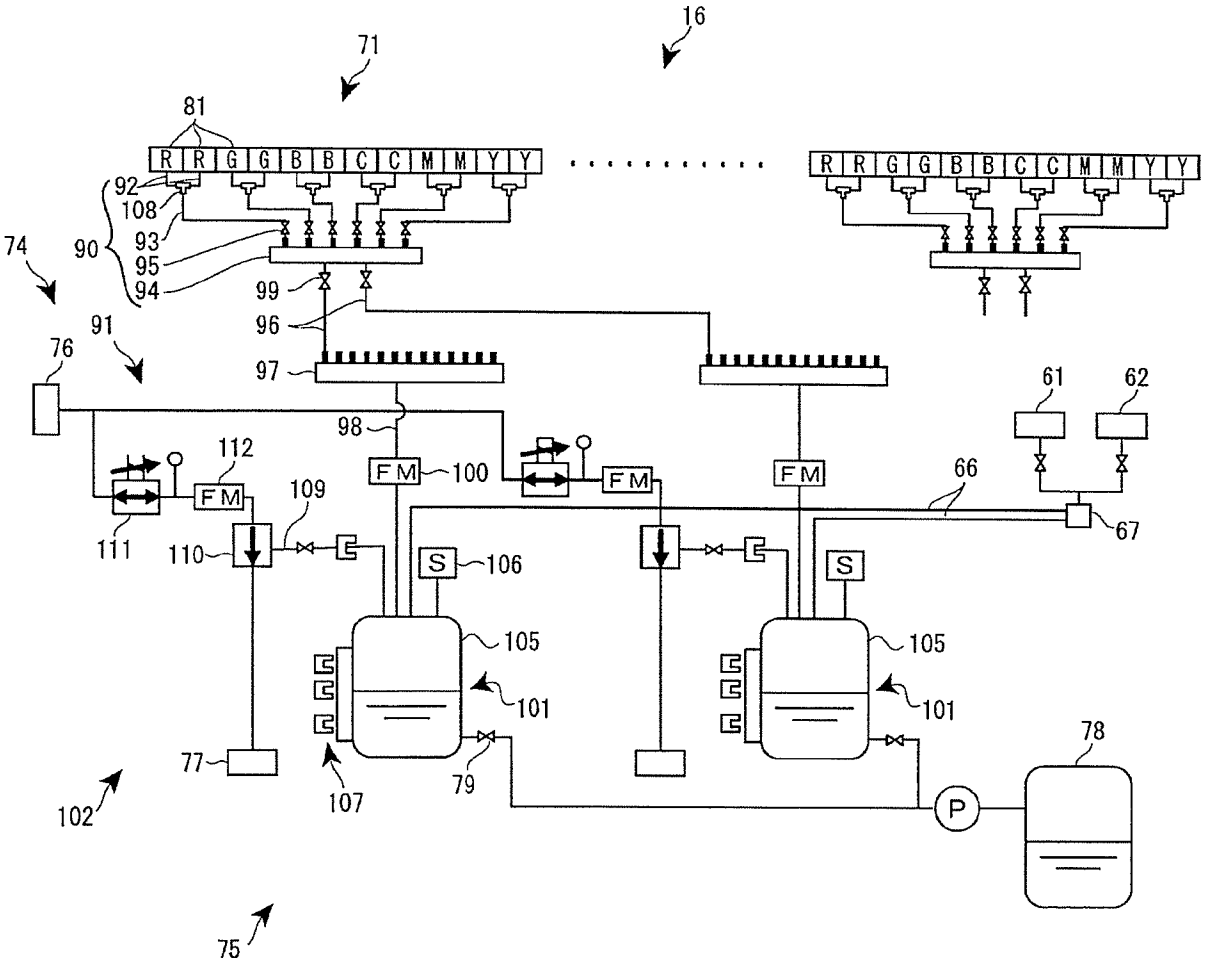
FIG. 8 is a piping system diagram of the suction unit.

The suction flow channel system 74 is composed of a cap-side flow channel system 90 connected to the cap units 71, and a tank-side flow channel system 91 connected to the cap-side flow channel system 90, as shown in FIG. 8. The cap-side flow channel system 90 is composed of homogenous flow channels 92 whose upstream ends are connected to the head caps 81, as well as individual suction flow channels 93 in which the downstream side of the homogenous flow channels 92 are merged in accordance with the color of the functional fluid via a merge joint 108, and a primary manifold 94 in which the downstream end of the merged individual suction flow channels 93 are connected. In other words, the two homogenous flow channels 92, which are connected to the 12 head caps 81 that correspond to the two (12 total) functional droplet discharging heads 13 for the above-noted six colors, merge via the merge joint 108 and are connected to the six individual suction flow channels 93. The downstream ends of the total of six individual suction flow channels 93 are connected to the primary manifold 94. Individual flow channel on-off valves 95 for opening and closing the individual suction flow channels 93 in accordance with the color of the functional fluid are disposed in the merged individual suction flow channels 93 on the downstream side.

The tank-side flow channel system 91 is composed of a plurality of distribution suction flow channels 96 in which the upstream ends are connected to the primary manifold 94, as well as two secondary manifolds 97 to which the downstream ends of the plurality of distribution suction flow channels 96 are connected, and main suction flow channels 98 in which the upstream ends are connected to the two secondary manifolds 97 and the downstream end is connected to the drainage tanks 101. Two distribution suction flow channels 96 per cap unit 71 are connected in correspondence with two pressure levels, and distribution flow channel on-off valves 99 for selectively switching between the two pressure levels is disposed in the distribution suction flow channels 96. A flow meter 100 for detecting the flow rate of the functional fluid that flows into the drainage tanks 101 is disposed in each main suction flow channel 98. The individual flow channel on-off valve 95 and the distribution flow channel on-off valve 99 are simple on-off valves, and the flow channels can be switched by setting one to "on" and the other to "off".

The primary manifold 94 and the two secondary manifolds 97 are composed of discoid manifolds formed in the shape of a funnel in which the upper end is closed by a disc-shaped lid unit. In this case, in the primary manifold 94, the downstream end of the six individual suction flow channels 93 are connected to the lid units so as to be uniformly arranged in the circumferential direction of the discoid manifold. Similarly, in the two secondary manifolds 97, the downstream end of the 13 distribution suction flow channels 96 are connected to the lid units so as to be uniformly arranged in the circumferential direction of the discoid manifolds or so as to be uniformly arranged in a double configuration in the circumferential direction.

The suction mechanism 75 is provided with two drainage tanks (liquid-suctioning tanks) 101 for draining (storing) functional fluid that has been suctioned away, and a pair of pressure control mechanisms 102 for controlling the internal pressure of the drainage tanks 101. The internal pressure of the drainage tanks 101 is individually adjusted by the pressure control mechanism 102, and a negative pressure (suctioning) is applied to the head cap 81 via the distribution suction flow channels 96. The functional fluid thus suctioned is thereby trapped in the drainage tanks 101.

The pressure control mechanism 102 is provided with a communication flow channel 109 in which the upstream side is connected to the upper space S of the drainage tanks 101; an ejector (suction device) 110 connected to the communication flow channel 109, the compressed-air supply apparatus 76, and the exhaust apparatus 77; an electropneumatic regulator 111 is disposed in the flow channel between the ejector 110 and the compressed-air supply apparatus 76 and is used for regulating the pressure of the compressed air supplied to the ejector 110; and a flow rate sensor 112 disposed in the line adjacent to the electropneumatic regulator 111. In other words, the ejector 110 introduces compressed air from the compressed-air supply apparatus 76 to the primary side and connects the secondary side to the upper space S of the drainage tanks 101. The pressure is regulated by the electropneumatic regulator 111, and the interior of the drainage tanks 101 is kept at a reduced pressure in which the air inside the communication flow channel 109 is drawn to the exhaust apparatus 77 side by the accompanying flow of the compressed air supplied to the ejector 110. The drainage tanks 101 are thereby individually regulated to a suitable suction pressure by the pressure control mechanism 102.

One of the two drainage tanks 101 is used as a high-pressure (first level) tank, and the other is used as a low-pressure (second level) tank. In other words, the high-pressure drainage tank 101 and the low-pressure drainage tank 101 are used in a suitable fashion to carry out the suctioning process in an efficient manner.

Figure 9:
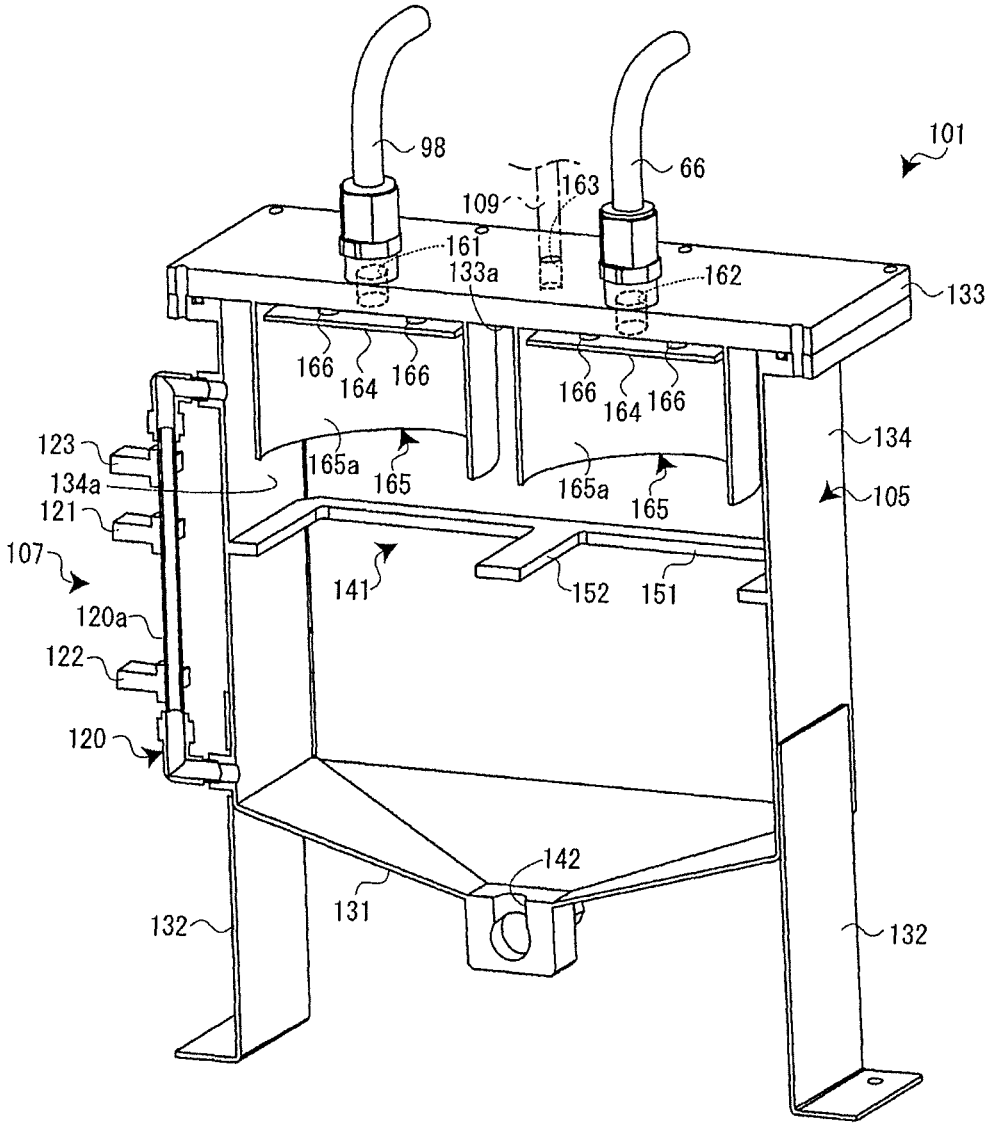
FIG. 9 is a cross-sectional perspective view of the drainage tanks.
Figure 10:
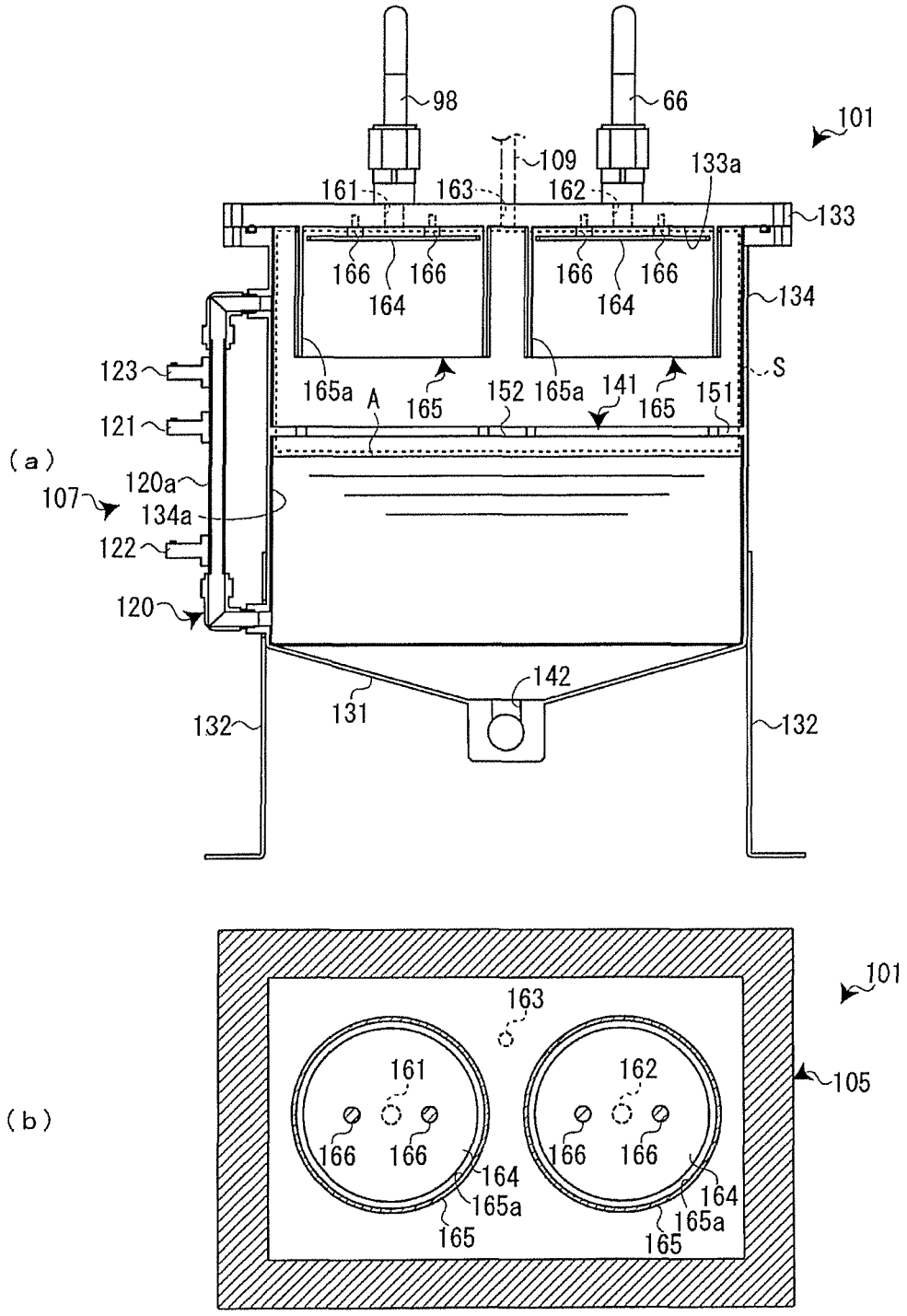
FIG. 10 includes a cross-sectional view (a) and a plan view (b) of the drainage tanks.

The drainage tanks 101 are described below with reference to FIGS. 8 through 10. Each drainage tank 101 is composed of a tank main unit 105 constituting a so-called sealed tank, a pressure gauge 106 connected to the upper space S of the tank main unit 105 and used for detecting the internal pressure, and fluid level detection means 107 disposed to the side of the tank main unit 105 and used for detecting the fluid level of the accumulated functional fluid, as shown in FIGS. 8 through 10. Each of the drainage tanks 101 is connected to the main suction flow channel 98, the functional fluid drainage apparatus 78 (communication flow channel 109), and the pressure control mechanism 102, as described above. The periodic flushing unit 62 and the pre-drawing flushing unit 61 described above are connected to the drainage tanks 101 via flushing flow channels 66. The flushing flow channels 66 are connected to the high-pressure drainage tank 101 and the low-pressure drainage tank 101, respectively, via a flow channel-switching valve 67, and are designed to switch connection to one or the other of the drainage tanks 101.

The fluid level detection means 107 is provided with a liquid column 120 that has a transparent section 120a and in which the upper and lower ends are in communication with the tank main unit 105; and an upper limit sensor 121, a lower limit sensor 122, and an overflow sensor 123 that face the transparent section 120*a* of the liquid column 120. The upper limit sensor 121 is arranged in a substantially intermediate position of the tank main unit 105 and is used for detecting the upper limit fluid level of the stored functional fluid. The lower limit sensor 122 is arranged below the upper limit sensor 121 and is used for detecting the lower limit fluid level of the stored functional fluid. The overflow sensor 123 is arranged above the upper limit sensor 121 and is used for detecting the overflow fluid level of the stored functional fluid. The control device opens a drainage on-off valve 79 disposed in the flow channel of the functional fluid drainage apparatus 78 side when the upper limit fluid level is detected, and drains the functional fluid in the functional fluid drainage apparatus 78. Conversely, the drainage on-off valve 79 is closed and drainage is ended when the lower limit fluid level is detected. When an overflow is detected, it is determined that an error has occurred, the driving of the pressure control mechanism 102 is halted, and the suctioning process is stopped.

The tank main unit 105 is formed in a substantially rectangular parallelepiped having a funnel-shaped bottom section 131, and is erectly supported by a pair of L-shaped support leg pieces 132, 132. The tank main unit 105 is provided with a lid section 133 that forms the ceiling (tank ceiling) 133*a*, and a tank section 134 that forms the peripheral wall and the bottom section 131. The lid section 133 is secured with a screw to the tank section 134.

The tank section 134 is provided with an inward protruding rib-shaped frame unit (annular frame unit) 141 that is provided in a substantially intermediate position of the tank inner wall 134*a*; and a liquid outflow port 142 opened in the bottom section 131 and to which the functional fluid drainage apparatus 78 is connected. Specifically, the liquid outflow port 142 is opened the top part of the funnel-shaped bottom section 131.

The frame unit 141 is provided with an annular rim frame 151 that follows the tank inner wall 134*a*, as well as a middle crosspiece 152 that extends from the rim frame 151 and transverses the middle of the tank. In this manner, the strength of the tank can be increased and the capacity of the tank can be increased with a thin plate material by providing the annular frame unit 141 in a substantially intermediate position of the tank inner wall 134*a*.

The lid section 133 (the ceiling 133*a* of the tank main unit 105) is provided with a first liquid inflow port (liquid inflow port) 161 opened in the ceiling 133*a* of the tank main unit 105 and connected to the main suction flow channel 98; a second liquid inflow port (liquid inflow port) 162 opened in the ceiling 133*a* of the tank main unit 105 and connected to the flushing flow channel 66; a gas outflow port 163 opened in the ceiling 133*a* of the tank main unit 105 and connected to the pressure control mechanism 102; two circular baffle plates 164 arranged directly below the liquid inflow ports 161, 162; and two cylindrical guide members 165 arranged so as to surround the baffle plates 164. In other words, the main suction flow channel 98, the flushing flow channel 66, and the pressure control mechanism 102 are in communication with the upper space S of the liquid surface A.

The baffle plates 164 are plates with which the functional fluid that has flowed in from the liquid inflow ports 161, 162 collides, and are horizontally arranged directly below the liquid inflow ports 161, 162 in the upper space S of the liquid surface A. The baffle plates 164 are suspended from the ceiling 133*a* of the tank main unit 105 by a pair of support rods 166.

The upper ends of the guide members 165 are secured to the ceiling 133*a* of the tank main unit 105, and the guide members are composed of a cylindrical body, which envelopes the baffle plates 164 with a predetermined gap therebetween. In other words, the internal peripheral surface (inner surface 165*a* of the guide members 165 are guiding walls that guide functional fluid that has collided with the baffle plates 164 to the liquid surface A. The lower ends of the guide members 165 are located substantially at the position of the overflow sensor 123 (the fluid level of overflow). A through-hole and/or a notched part (not shown) that places the interior and the exterior of the guide members 165 in communication may be formed in the guide members 165, whereby the pressure inside and outside the guide members 165 can be made uniform.

The functional fluid that has flowed in from the liquid inflow ports 161, 162 collides with the baffle plates 164 arranged direction below and is thereafter guided by the guide members 165 from the baffle plates 164 to the liquid surface A.

The gap surface area formed by a predetermined gap between the guide members 165 and the baffle plates 164 and the cross-sectional surface area of the liquid inflow ports 161, 162 are formed to be substantially the same. Functional fluid can thereby be smoothly guided to the liquid surface A while the dispersion of the functional fluid is suppressed, because the flow rate from the liquid inflow ports 161, 162 and the flow rate from the gap between the guide members 165 and the baffle plates 164 are made to be substantially the same.

In accordance with this configuration, the falling distance of the functional fluid that has flowed in from the liquid inflow ports 161, 162 can be reduced and the functional fluid is guided to the liquid surface A at a reduced the flow rate. Therefore, dispersion of the functional fluid to the liquid surface A can be suppressed. The liquid inflow ports 161, 162 will not be submerged below the liquid surface A (in the fluid) even when the height of the liquid surface A has risen.

Corrosion of the liquid inflow ports 161, 162 can be suppressed by providing the liquid inflow ports 161, 162 in the ceiling 133*a* of the tank main unit 105. Also, since the baffle plates 164 that receive the functional fluid from the liquid inflow ports 161, 162 are horizontally provided, the functional fluid flows down the baffle plates 164 in a radial fashion. Accordingly, the flow rate of the fluid that has flowed down is dramatically reduced and can thereafter be guided to the guiding wall. A guiding wall (guide member 165) is furthermore provided so as to envelope the baffle plate, whereby the guiding wall serves as a liquid-proofing cover, and the functional fluid that has collided with the baffle plate 164 can be prevented from dispersing to the entire liquid-suctioning tank 101. Function as the liquid-proofing cover can be enhanced by furthermore securing the guide members 165 to the tank ceiling wall 133*a*.

In the present embodiment, the guide members 165 are arranged in the upper space S of the liquid surface A, but it is possible to use a configuration in which the lower end of the guide members 165 extend to the vicinity of a tank bottom wall (bottom section 131). In such a case, functional fluid that has collided with the baffle plates 164 can be guided at a low speed to the liquid surface A without regard for the height of the liquid surface A because the lower ends of the guide members 165 extend to the vicinity of the tank bottom wall (bottom section 131).

Figure 11:
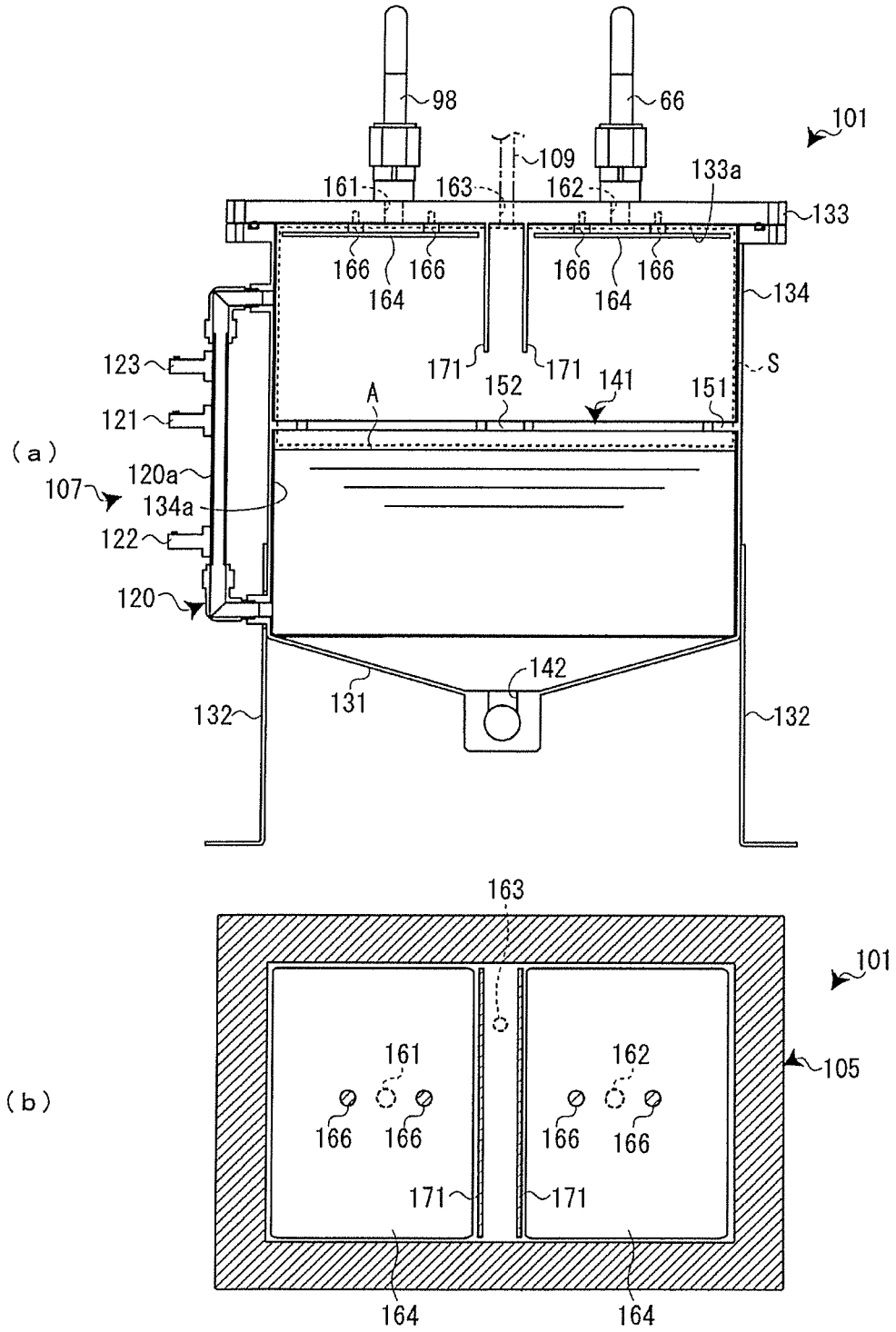
FIG. 11 includes a cross-sectional view (a) and a plan view (b) of the drainage tanks of the first modified example.
Figure 12:
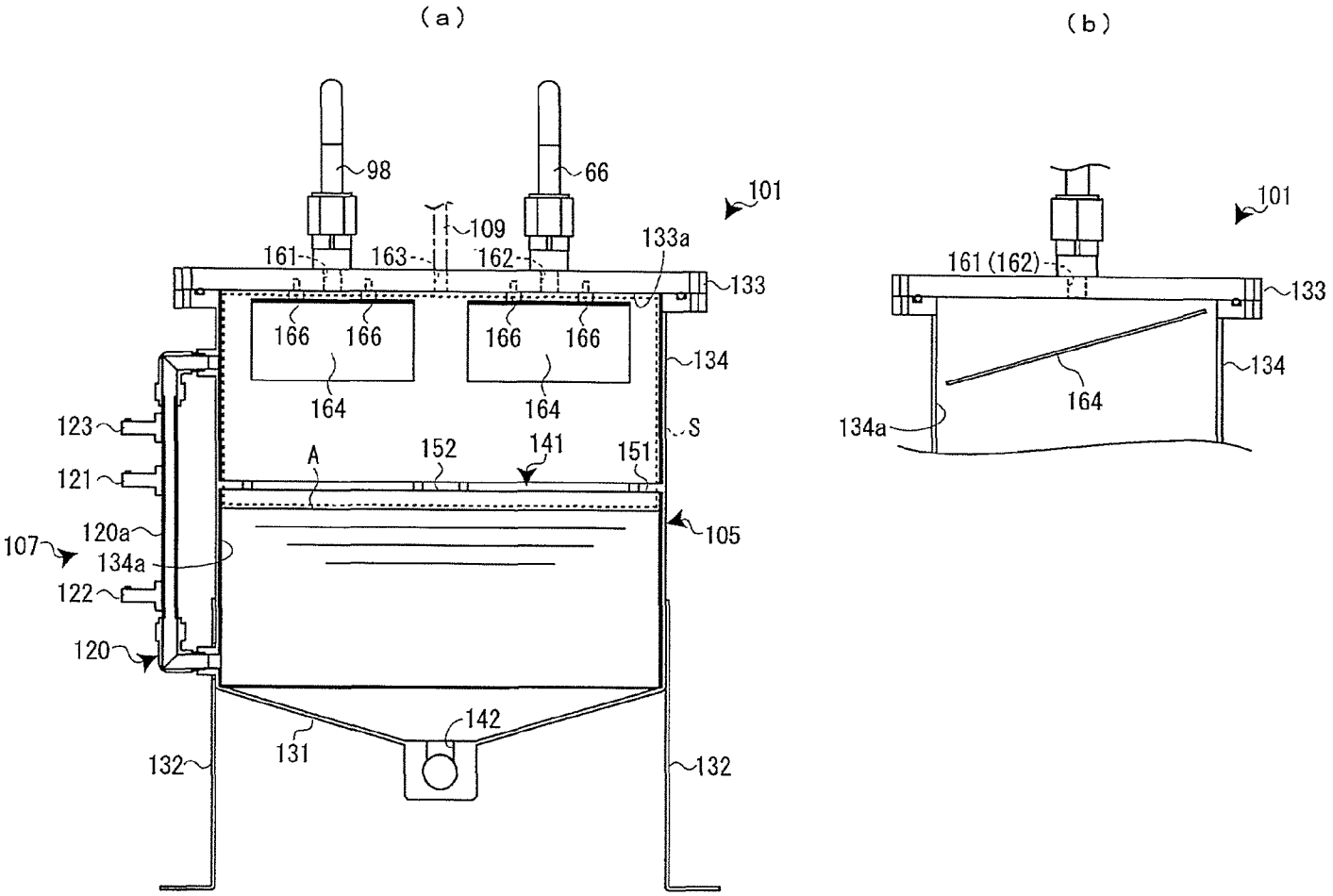
FIG. 12 includes a cross-sectional view (a) and a longitudinal sectional view (b) of the drainage tanks of the second modified example.

Next, first and second modified examples of the drainage tanks 101 will be described with reference to FIGS. 11 and 12, with descriptions only being provided for those portions that differ from the embodiment described above. FIG. 11 is a cross-sectional view (a) and a plan view (b) of the drainage tanks 101 of the first modified example. FIG. 12 is a cross-sectional view (a) and a longitudinal sectional view (b) of the drainage tanks 101 of the second modified example.

The drainage tanks 101 of the first modified example exclude the cylindrical guide members 165, as shown in FIG. 11. In the drainage tanks 101 of the first embodiment, the baffle plates 164 are quadrangularly formed, and three sides of the baffle plates are formed so as to face the tank inner wall 134*a* with a predetermined gap therebetween. Specifically, excluding the right side, three sides of the baffle plate 164 of the first liquid inflow port 161 provided on the left side face the tank inner wall 134*a*; and excluding the left side, three sides of the baffle plate 164 of the second liquid inflow port 162 provided on the right side face the tank inner wall 134*a*. On the other hand, two flat guiding plates 171 secured to the ceiling 133*a* are provided as a portion of the guide members 165, and the flat guiding plates face with a predetermined gap in the side to which the baffle plates 164 do not face the tank inner wall 134*a*. Accordingly, the functional fluid that has flowed in from the liquid inflow ports 161, 162 collides with the baffle plates 164 and is thereafter guided from the baffle plates 164 to the liquid surface A by the flat guiding plates 171 and the tank inner wall 134*a*. In other words, the tank inner wall 134*a* is configured to double as a portion of the guide members 165. In accordance with this configuration, the drainage tanks 101 can be provided with a simple configuration because the guide members 165 and the tank inner wall 134*a* of the drainage tanks 101 can be integrally formed (double as).

The drainage tanks 101 of the second modified example have a configuration that excludes the cylindrical guide members 165 and uses a quadrangular flat plate arranged with a downward slope as the baffle plates 164, as shown in FIG. 12. The downstream ends of the baffle plates 164 face the tank inner wall 134*a* with a predetermined gap. Accordingly, the functional fluid that has flowed in from the liquid inflow ports 161, 162 collides with the baffle plates 164, and is then guided by the baffle plates 164 to the tank inner wall 134*a* and afterward to the liquid surface A. In other words, the tank inner wall 134*a* is configured to double as the guide members 165. In accordance with this configuration, the drainage tanks 101 can be provided with a simple configuration because the guide members 165 and the tank inner wall 134*a* of the drainage tanks 101 can be integrally formed (i.e., be of dual-purpose construction).

In the first and second modified examples, the frame unit 141 acts to reduce the flow rate of the functional fluid that flows down along the tank inner wall 134*a*.

In the present embodiment, a configuration is used in which six functional fluid colors; i.e., R (red), G (green), B (blue), C (cyan), M (magenta), and Y (yellow), are supplied to a functional droplet discharging head 13, but the number and color type of the functional fluid can be set as desired.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid-suctioning tank comprising:

a first liquid inflow port and a second liquid inflow port communicating with an upper space of a surface of a liquid when the liquid is stored in the liquid-suctioning tank, the first liquid inflow port and the second liquid inflow port being configured and arranged to be connected to a liquid-suctioning object, the first liquid inflow port and the second liquid inflow port being opened in a ceiling of the liquid-suctioning tank;

a gas outflow port communicating with the upper space, and configured and arranged to be connected to a suctioning device so that a negative pressure is applied to the upper space by the suctioning device to trap liquid from the liquid-suctioning object using suction;

a first baffle plate and a second baffle plate suspended from the ceiling of the liquid-suctioning tank and disposed in the upper space so that the liquid flowing from the first liquid inflow port collides against the first baffle plate and the liquid flowing from the second liquid inflow port collides against the second baffle plate;

a support rod suspending the first baffle plate and the second baffle plate on the ceiling of the liquid-suctioning tank; and a guide member having a guiding wall configured and arranged to guide the liquid that has collided with the first baffle plate or the second baffle plate from the first baffle plate and the second baffle plate toward the surface of the liquid, the guiding wall is disposed between the first liquid inflow port and the second liquid inflow port, and between the first baffle plate and the second baffle plate.

2. The liquid-suctioning tank according to claim 1, wherein an upper end of the guide member is secured to the ceiling of the liquid-suctioning tank.

3. The liquid-suctioning tank according to claim 1, wherein an inner wall of the liquid-suctioning tank forms a part of the guiding wall.

4. The liquid-suctioning tank according to claim 1, wherein each of the first baffle plate and the second baffle plate is arranged with a slope having a downstream end facing an inner wall of the liquid-suctioning tank with a gap therebetween, and the inner wall of the liquid-suctioning tank forms the guide member.

5. The liquid-suctioning tank according to claim 1, further comprising an annular frame unit provided in a generally vertical intermediate position of an inner wall of the liquid-suctioning tank.

6. The liquid-suctioning tank according to claim 1, wherein the guiding wall is arranged apart from an inner wall of the liquid-suctioning tank.

7. The liquid-suctioning tank according to claim 1, wherein the guide wall has a first guide wall and a second guide wall, the first guide wall is arranged around the first liquid inflow port and the first baffle plate, the second guide wall is arranged around the second liquid inflow port and the second baffle plate, and the gas outflow port is arranged between the first guide wall and the second guide wall.

8. The liquid-suctioning tank according to claim 1, wherein the first baffle plate and the second baffle plate are horizontally arranged directly below the first liquid inflow port and the second liquid inflow port, respectively, and the guide wall has a first guide wall and a second guide wall that have cylindrical bodies that enclose the first baffle plate and the second plate, respectively so that an inner surface of the guide member forms the first guiding wall and the second guide wall.

9. The liquid-suctioning tank according to claim 8, wherein a surface area of a gap between the guide member and the first baffle plate is substantially the same as a cross-sectional area of the first liquid inflow port, and a surface area of a gap between the guide member and the second baffle plate is substantially the same as a cross-sectional area of the second liquid inflow port.

10. The liquid-suctioning tank according to claim 1, wherein the lower end of the guide member extends to a vicinity of a bottom wall of the liquid-suctioning tank.

11. The liquid-suctioning tank according to claim 10, wherein the guide member includes a through-hole.

12. The liquid-suctioning tank according to claim 1, wherein the first liquid inflow port and the second liquid inflow port are configured and arranged to be connected to a suction cap as the liquid-suctioning object configured and arranged to suction functional fluid from an ink-jet head with the suction cap being selectively detachable from the ink-jet head, and the gas outflow port is configured and arranged to be connected to an ejector as the suctioning device with the ejector having a secondary side connected to the first liquid inflow port and the second liquid inflow port.

13. A droplet discharge device comprising:

the liquid-suctioning tank according to claim 12;

the suction cap connected to the liquid-suctioning tank;

the ink-jet head from which the suction cap is selectively detached; and the ejector connected to the liquid-suctioning tank.

* * * * *